United States Patent [19]

Sugimoto

[11] Patent Number: 4,766,654

[45] Date of Patent: Aug. 30, 1988

[54] PUSH BUTTON BUCKLE ASSEMBLY FOR A SEAT BELT

[75] Inventor: Mutsumi Sugimoto, Hamamatsu, Japan

[73] Assignee: Katsuyama Kinzoku Kogyo Kabushiki Kaisha, Shizuoka, Japan

[21] Appl. No.: 715,242

[22] Filed: Mar. 22, 1985

[30] Foreign Application Priority Data

Oct. 19, 1984 [JP] Japan ..... 59-219698
Nov. 23, 1984 [JP] Japan ..... 59-177583[U]

[51] Int. Cl.[4] ..... A44B 11/26
[52] U.S. Cl. ..... 24/637; 24/651
[58] Field of Search ..... 24/633, 636, 638, 639, 24/640, 641, 642, 651, 637; 297/468; 280/801

[56] References Cited

U.S. PATENT DOCUMENTS

| | | | |
|---|---|---|---|
| 3,494,007 | 2/1970 | Dahms | 24/637 |
| 3,605,209 | 9/1971 | Alarzon | 24/637 |
| 3,708,838 | 1/1973 | Gonzalez | 24/637 |
| 3,877,115 | 4/1975 | Quinting | 24/642 |
| 4,127,922 | 12/1978 | Mita | 24/637 |
| 4,262,396 | 4/1981 | Koike | 24/639 |
| 4,339,854 | 7/1982 | Ikesue | 24/639 X |
| 4,377,888 | 3/1983 | Ikesue | 24/637 |
| 4,587,696 | 5/1986 | Ueda et al. | 24/637 |

FOREIGN PATENT DOCUMENTS

| | | | |
|---|---|---|---|
| 2100105 | 7/1972 | Fed. Rep. of Germany | 24/645 |
| 2491764 | 4/1982 | France | 24/641 |
| 59-22505 | 2/1984 | Japan . | |
| 59-28904 | 2/1984 | Japan . | |
| 1162433 | 8/1969 | United Kingdom | 24/637 |
| 1184710 | 3/1970 | United Kingdom | 24/637 |
| 1531823 | 11/1978 | United Kingdom | 24/637 |

*Primary Examiner*—Peter A. Aschenbrenner
*Assistant Examiner*—James R. Brittain
*Attorney, Agent, or Firm*—Bruce L. Adams; Van C. Wilks

[57] ABSTRACT

A seat belt buckle assembly, for quick release engagement with a mating tongue, has a latch mounted on a base for pivotal motion between a latching position, where the latch engages the tongue against withdrawal from the buckle assembly, and an unlatching position where the latch releases the tongue. A push button is also pivotally mounted on the base in an overlying relation to the latch. Interposed between the latch and the push button is a dual purpose spring capable of acting on both latch and push button for biasing the latch from the unlatching toward the latching position, and the push button away from the latch. For causing the latch to release the tongue, the push button is to be pushed manually against the force of the dual purpose spring, whereupon the push button acts directly on the latch for pivoting the same from the latching to the unlatching position against the force of the dual purpose spring. The buckle assembly may additionally include a push-out spring for throwing the tongue out of the buckle assembly when the tongue is unlatched.

37 Claims, 18 Drawing Sheets

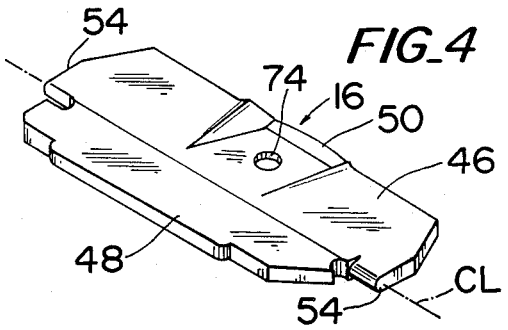
FIG_4
FIG_5
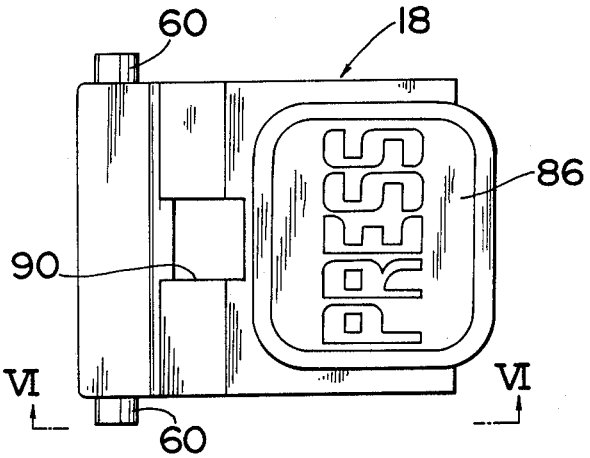
FIG_6
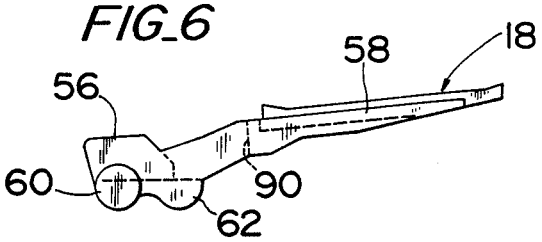

PUSH BUTTON BUCKLE ASSEMBLY FOR A SEAT BELT

BACKGROUND OF THE INVENTION

This invention relates to seat belts designed to secure persons in motor vehicles, aircraft, etc., for safety purposes, and more particularly to a buckle assembly for use in such seat belts. Still more particularly, the invention concerns a push button buckle assembly of the metal to metal design, which is fastened to the end of one length of webbing for mating engagement with a tongue which is fastened to the end of another length of webbing.

The seat belt buckle assembly comprises, in essence, a quick release connector capable of positively latching the tongue when the tongue is inserted in the buckle assembly. Once engaged with the tongue, the buckle assembly should not unlatch the tongue in the face of any external forces, other than the buckle release force on the push button, that may be exerted on the buckle assembly in use. The buckle assembly should, nevertheless, readily unlatch and disconnect the tongue upon exertion of the release force on the push button by the wearer of the seat belt.

A variety of buckle assemblies have been suggested for the fulfilment of the above contradictory requirements. Examples are Japanese Patent Laid Open Patent Application Nos. 59-22505 and 59-28904, both filed by the instant applicant and made open to public inspection on Feb. 4, 1984 and Feb. 15, 1984, respectively. Such conventional buckle assemblies are mostly unsatisfactory, however, because of the large numbers of component parts, and/or of the complex shapes and structures of the component parts intricately interrelated both mechanically and functionally. Not only is the fabrication of such complex parts very troublesome and costly, but also they make the assemblage of the buckle assemblies highly difficult, adding substantially to their manufacturing costs.

SUMMARY OF THE INVENTION

The present invention has succeeded in reducing the number of the component parts of a seat belt buckle assembly of the push button release type without in any way adversely affecting the operating functions of the buckle assembly for which it is intended. Further the components are simplified in construction and well designed for the ease of assemblage.

The invention may be briefly summarized as a buckle assembly capable of positive and quick release engagement with a tongue in a seat belt, comprising a base having a generally flat major portion with a pair of opposed side walls provided on its opposite sides. The base has a generally flat major portion of approximately rectangular shape and a pair of opposed side walls formed on and extending along the opposite sides of the major portion. The side walls have first and second pairs of opposed apertures provided therein. The first pair of apertures are located intermediate the front end of the base, through which the tongue is inserted into and withdrawn from the buckle assembly, and the rear end of the base opposite the front end, whereas the second pair of opposed apertures are located at the front end of the base. A latch has its pair of opposite ends loosely engaged in the first pair of apertures in the side walls of the base for pivotal motion about a first axis relative to the base between a latching position for positive engagement with the tongue inserted into the buckle assembly and an unlatching position for releasing the tongue. Generally overlying the latch, a push button has a pair of trunnions rotatably engaged in the second pair of apertures in the side walls of the base for pivotal motion about a second axis parallel to the first axis, relative to the base between a normal position for holding the latch in the latching position and a working position for holding the latch in the unlatching position. Also included is a dual purpose spring which is disposed between the latch and the push button and which acts on both the latch and the push button for normally holding the charging latch in the latching position and the push button in the normal position. When the push button is activated manually from the normal position to the working position against the force of the dual purpose spring, the push button acts directly on the latch for pivoting the same from the latching position to the unlatching position against the force of the dual purpose spring.

Thus the seat belt buckle assembly of this invention is composed of a minimum number of components, namely, the base, latch, push button, and dual purpose spring. These components are further simplified in construction as far as feasible, with a due regard, however, to the ease of assemblage, so that they can be readily assembled for the provision of an inexpensive but reliable buckle assembly.

One of the features distinguishing the present invention from the noted prior art, particularly the Japanese Laid Open Patent Application No. 59-22505, is the fact that the push button is pivotally mounted directly on the base by having its trunnions rotatably engaged in the second pair of apertures in the base, instead of via a push button mount formed integral with the dual purpose spring. This makes it possible not only to mount the push button on the base more easily than heretofore, but also to materially simplify the configuration of the dual purpose spring as compared with the conventional one in one integrated piece with the push button mount. The simplified dual purpose spring is designed to prevent entangling with other similar springs when a number of such springs are held together in the manufacture of the buckle assemblies in accordance with the invention. The direct mounting of the push button on the base can be further expedited by means disclosed herein.

As the push button is mounted directly on the base as above described, the push button, when depressed acts on the latch by leverage via a pair of lugs depending from the push button in the vicinity of its trunnions, causing the latch to pivot from its latching position to unlatching position against the bias of the dual purpose spring. Only a light finger pressure is required for unlatching the tongue. Further, since the latch is constantly urged to hold its latching position, the tongue can be positively engaged therewith upon full insertion in the buckle assembly.

An additional feature of the invention resides in a push-out spring for pushing the tongue out of the buckle assembly when it is unlatched by the depression of the push button. Preferably, the push-out spring is made of a strip of resilient material which may be formed into the approximate shape of a "Z", "U", etc. Such a push-out spring can be compactly mounted on the major portion of the base, at least partly in an underlying relation to the latch, as it requires a minimal space in a direction normal to the major portion of the base. As the push-out spring can thus be installed in the dead space within the buckle assembly that has heretofore been left unoccupied, the size of the buckle assembly can be kept at a minimum despite the provision of the push-out spring.

The above and other features and advantages of this invention and the manner of realizing them will become more apparent, and the invention itself will best be understood, from a study of the following description and appended claims, with reference to the attached drawings showing some preferable embodiments of the invention.

BRIEF DESCRIPTION OF THE DRAWINGS

FIG. 4 is a perspective view of the latch of the buckle assembly of FIGS. 1 through 3;

FIG. 5 is a top plan view of the push button of the buckle assembly of FIGS. 1 through 3;

FIG. 6 is a side elevation of the push button as seen in the direction of the arrows VI in FIG. 5;

DESCRIPTION OF THE PREFERRED EMBODIMENTS

General

Figure 1:
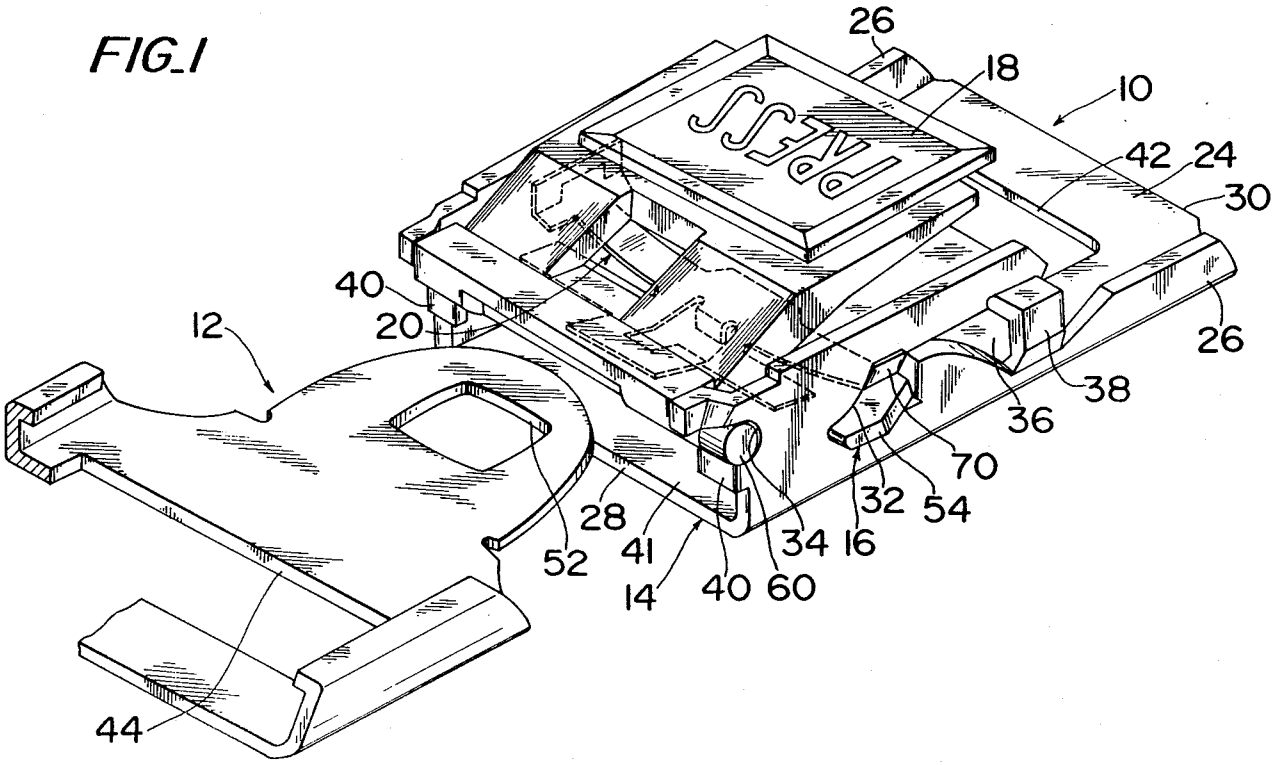
FIG. 1 is a perspective view of the push button buckle assembly constructed in accordance with the novel concepts of this invention, the buckle assembly being shown without its cover, and shown together with the tongue for mating engagement therewith.

The seat belt buckle assembly in accordance with the invention will now be described in terms of its first preferred form illustrated in FIGS. 1 through 11C. The general structure of the exemplified buckle assembly will be understood from a study of FIGS. 1 through 3. As generally designated 10 in FIGS. 1 and 2, the buckle assembly 10 is shown together with a tongue 12 for mating engagement with the buckle assembly. The buckle assembly 10 has a base 14 on which various working components of the buckle assembly are mounted. The base 14 is coupled to the end of one length of webbing, now shown, whereas the tongue 12 is coupled to the opposed end of another length of webbing, also not shown, so that the two webbing lengths can be fastened together as the buckle assembly 10 engages the tongue 12.

A latch 16 is mounted on the base 14 for pivotal motion about an axis extending transversely of the base, into and out of positive engagement with the tongue 12 inserted in the buckle assembly 10. Also mounted on the base 14 is a push button 18 generally overlying the latch 16 and pivotable relative to the base about an axis parallel to the axis about which the latch pivots on the base. This push button is actuated manually, by the application of thumb pressure, for acting directly on the latch 16 to cause the same to release the tongue 12. A dual purpose spring 20 is interposed between latch 16 and push button 18 both for biasing the latch into engagement with the tongue 12 received in the buckle assembly 10 and for biasing the push button away from the latch. Thus, in order to cause the buckle assembly 10 to release the tongue 12, the push button 18 is pressed against the bias of the dual purpose spring 20. The push button 18 then acts on the latch 16 by leverage to cause the same to pivot out of engagement with the tongue 12 in opposition to the force of the dual purpose spring 20.

Figure 3:
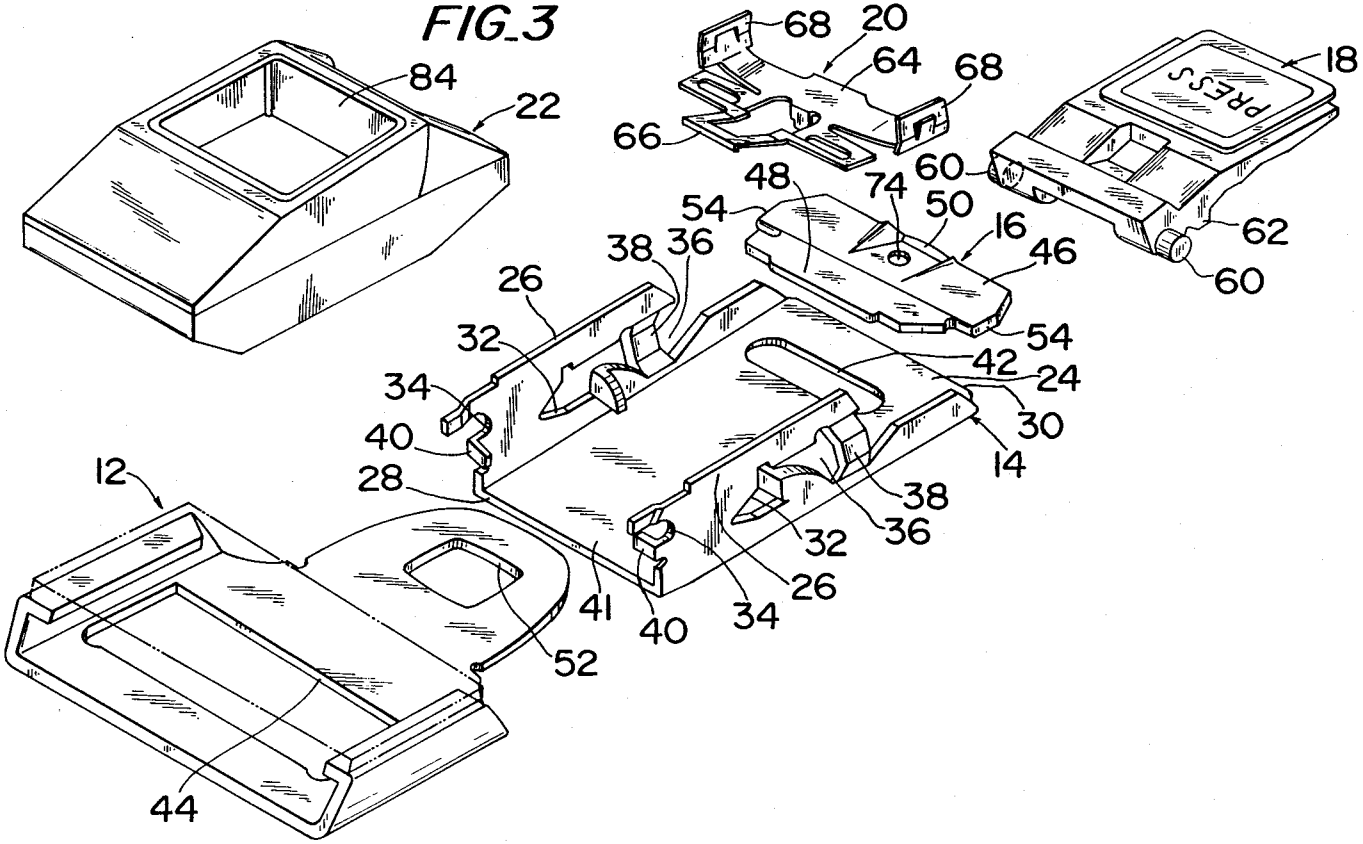
FIG. 3 is an exploded perspective view of the buckle assembly and tongue of FIGS. 1 and 2, drawn on a reduced scale for illustrative convenience in comparison with FIGS. 1 and 2, the buckle assembly being shown together with the buckle cover.

FIG. 3 further shows a buckle cover 22 that may be secured to the base 12 to enclose the latch 16, push button 18, and dual purpose spring 20. The buckle cover 22 leaves part of the push button 18 exposed for the direct application of hand pressure thereto.

The following is a more extensive discussion of the above listed components of the buckle assembly 10, namely, the base 14, latch 16, push button 18, dual purpose spring 20, and buckle cover 22, in that order and under the respective headings. The operational description of the complete buckle assembly 10, in relation to the tongue 12, will follow the discussion of the buckle assembly components.

Base

Figure 2:
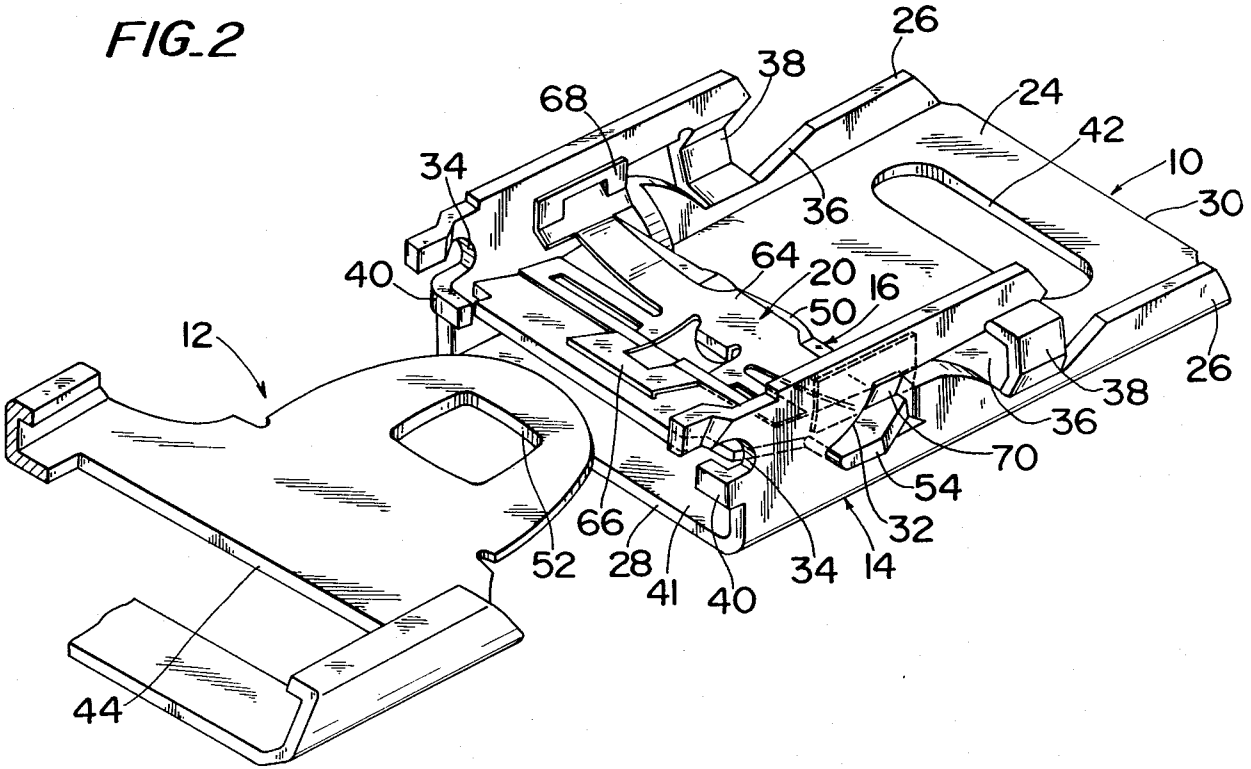
FIG. 2 is a view similar to FIG. 1 except that the push botton is removed from the buckle assembly.

The configuration of the base 14 will be understood from an inspection of FIGS. 1 through 3. Broadly, the base 14 comprises a generally flat major portion 24 of approximately rectangular shape, and a pair of side walls 26 bent right angularly from the opposite sides of the major portion 24 into a confronting relation with each other. For the convenience of description the end 28 of the base 14, through which the tongue 12 is inserted in and withdrawn from the buckle assembly 10, will hereinafter be referred to as the front end, and the opposite end 30 of the base 14 as the rear end.

The side walls 26 of the base 14 have therein a first pair of opposed apertures 32 located intermediate the front end 28 and rear end 30 of the base, and a second pair of opposed apertures 34 located at or adjacent to the front end 28 of the base. The first pair of apertures 32 are intended for use in pivotally mounting the latch 16 on the base 14, and the second pair of apertures 34 are used for pivotally mounting the push button 18 on the base. Thus the latch 16 and the push button 18 pivot on the base 14 about the respective axes parallel to each other.

The first pair of apertures 32 are in open communication respectively with a pair of passageways 36 in the side walls 26. These passageways are open at the rear end of the base, these passageways 36 are intended to facilitate the mounting of the latch 16 on the base 14, during the assemblage of the buckle assembly 10, as will be later explained in more detail. Each side wall 26 is reinforced by an integral bridge 38 having its opposite ends anchored respectively to the opposite edges of the side wall bounding the passageway 36. The pair of bridges 38 on the side walls 26 bulge away from each other so as not to interfere with the act of pivotally mounting the latch 16 on the base 14.

The second pair of apertures 34 in the side walls 26 are preferably circular or semicircular in shape and open at the front end of the base 14 to expedite the pivotal mounting of the push button 18 thereon. Just under the second pair of apertures 34 there are formed a pair of projections 40 extending inwardly or toward each other from the front ends of the side walls 26 to serve as bearings for the push button 18, as will be referred to in the course of the detailed description of the push button. It will further be noted that these projections 40 are spaced from the major portion 24 of the base 14 to define in combination therewith an entrance opening 41 for the insertion of the tongue 12 in the buckle assembly 10. The undersides of the projections 40 facing, the major portion 24 of the base 14, therefore functions as guides for the travel of the tongue 12 onto and out of the buckle assembly 10.

The major portion 24 of the base 14 has therein a slotlike opening 42 extending transversely of the base in the vicinity of its rear end 30. One length of seat belt webbing is inserted into and through this opening 42 fastening the buckle assembly 10 to its free end. The tongue 12 has a similar opening 44 cut therein to be fastened to the free end of another length of seat belt webbing.

Latch

Although the latch 16 appears in all of FIGS. 1 through 3, it is better illustrated by an enlarged scale in FIG. 4. The latch 16 comprises a major or body portion 46 and a counterbalance portion 48 an approximately V shaped section as taken in the front to rear longitudinal direction of the buckle assembly 10. The major portion 46 has a pawl 50 protruding therefrom toward the rear end 30 of the base 14 for engagement with a square opening 52 of the tongue 12 as shown in FIGS. 1 through 3. Further, the major portion 46 has a pair of lugs 54 at its opposite lateral ends for pivotal engagement with the aforesaid first pair of apertures 32 in the side walls 26 of the base 14. So mounted on the base 14, the latch 16 pivots between a latching position, where its pawl 50 is engageable with the opening 52 of the tongue 12 as the tongue is inserted into the buckle assembly 10, and an unlatching position where the pawl 50 disengages from the tongue.

As the name implies, the counterbalance portion 48 of the latch 16 is intended to counterbalance the total weight of its major or body portion 46, pawl 50 and lugs 54. Thus, when the latch 16 is mounted in position on the base 14 as shown in FIGS. 1 and 2, the axis CL about which the latch pivots relative to the base extends through the center of gravity of the latch in the front-to-rear direction of the base. Such balancing of the latch 16 to maintain the latch in positive engagement with the tongue 12 in the face of external forces that may be exerted on the buckle assembly 10 during use.

As has been set forth in connection with the base 14, the first pair of apertures 32 in the side walls 26 of the base are open rearwardly via the passageways 36. The pair of lugs 54 of the latch 16 can therefore be readily disposed in the apertures 32 by inserting the latch 16 through the passageways 36 during the assemblage of the buckle assembly 10. Thus the provision of the rearwardly open passageways 36, together with the outwardly bulging bridges 38 each having its opposite ends anchored to the opposite edges bounding one passageway 36, is effective to facilitate the assemblage of the buckle assembly 10, particularly if such assemblage is automated.

Push Button

Figure 7:
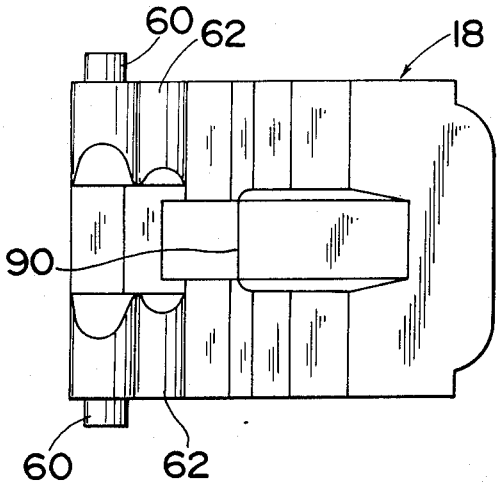
FIG. 7 is a bottom plan view of the push button of FIGS. 5 and 6.

The push button 18 is illustrated in detail in FIGS. 5 through 7. Preferably, the push button 18 is made of an integral molding of plastics material, although it may be fabricated from metal if desired. Whichever the material may be, the push button 18 may have its front end portion 56 made thicker than its rear end portion 58 by way of reinforcement, as will be best understood from FIG. 6.

A pair of trunnions 60 project laterally from the front end of the push button 18. These trunnions 60 are rotatably disposed in the second pair of apertures 34 in the side walls 26 of the base 14. As the push button is pivotally mounted on the base 14, the push button 18 generally overlies the latch 16 for directly actuating the same in a manner yet to be described. If the push button 18 is molded of plastics material, the trunnions 60 may be made of either of the same material or of metal. Metal-made trunnions may be press-fitted in preformed bores in the molded push button. Since the second pair of apertures 34 are open forwardly of the base 14 as aforesaid, the trunnions 60 can be readily forced into these apertures. When the trunnions are received in the apertures 34, the trunnions 60 further rotatably rest on the respective inward projections 40 of the base 14.

The push button 18 further includes a pair of transversely spaced part, and depending lugs 62 formed in one piece therewith just rearwardly of the trunnions 60. Upon depression of the push button 18, its depending lugs 62 make abutting engagement with the counterweight portion 48 of the latch 16, causing the same to disengage from the tongue 12.

Dual Purpose Spring

Figure 8:
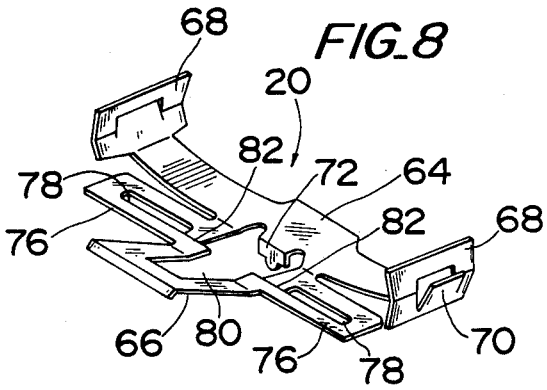
FIG. 8 is a perspective view of the dual purpose spring of the buckle assembly of FIGS. 1 through 3.

FIG. 8 best illustrates the integral dual purpose spring 20 interposed between the latch 16 and the push button 18. The dual purpose spring 20 comprises a first portion 64 for acting on the latch 16 to normally hold the same in the latching position, and a second portion 66 for acting on the push button 18 for biasing the same away from the latch. The first portion 64 of the dual purpose spring 20 will hereinafter be referred to as the latch spring portion, and its second portion 66 as the push button spring portion.

The latch spring portion 64 has a pair of flanges 68 provided on its opposite ends, and generally extending transversely of the base 14. These flanges 68 are held flatwise against the inside surfaces of the side walls 26 of the base 14, as will be best understood from FIG. 2. Parts 70 of the flanges 68 are further bent outwardly and upwardly to positively engage in the first pair of apertures 32 in the side walls 26 of the base 14. The dual purpose spring 20 is thus mounted in position on the base 14. The intermediate portion of the latch spring portion 64 is deflectably convexed toward the major portion 24 of the base 14. Depending from the midpoint of the latch spring portion 64 is a lug 72 which is firmly caught in a hole 74, as shown in FIGS. 3 and 4, provided centrally in the major portion 46 of the latch 16. Thus the latch spring portion 64 acts on the latch 16 via the depending lug 72, biasing the latch to keep its latching position. The lug 72 of the latch spring portion 64 serves the additional function of locking the latch against possible displacement in the longitudinal direction of the base 14.

The push button spring portion 66 of the dual purpose spring 20 has a trip end which extends forwardly from the latch spring portion 64 into abutment against the underside of the push button 18, thus acting as a restoring spring for the push button. For the exertion of a due restoring force on the push button 18, the push button spring portion 66 has a pair of wings 76 extending laterally therefrom in the opposite directions. Each wing 76 has therein a slot 78 which communicates with a relatively large aperture 80 in the push button spring portion 66 via a slit 82. Normally, or when the dual purpose spring 20 is under no load, each slit 82 is closed; that is, the opposite edges bounding the slit butt on each other in one and the same plane. Such closure of the slits 82 is effective, when a number of dual purpose springs 20 are stacked or otherwise held together in the manufacture or assemblage of buckle assemblies in accordance with the invention, to prevent the springs from entangling with one another.

Buckle Cover

The buckle cover 22 seen in FIG. 3 is placed over the rest of the buckle assembly components 14, 16, 18 and 20 that have been assemblied together as shown in FIG. 1. As the buckle cover 22 is rigidly coupled to the base 14, the buckle cover 22 coacts therewith to thoroughly enclose the latch 16 and dual purpose spring 20, leaving the push button 18 partly exposed for manual activation.

Figure 9:
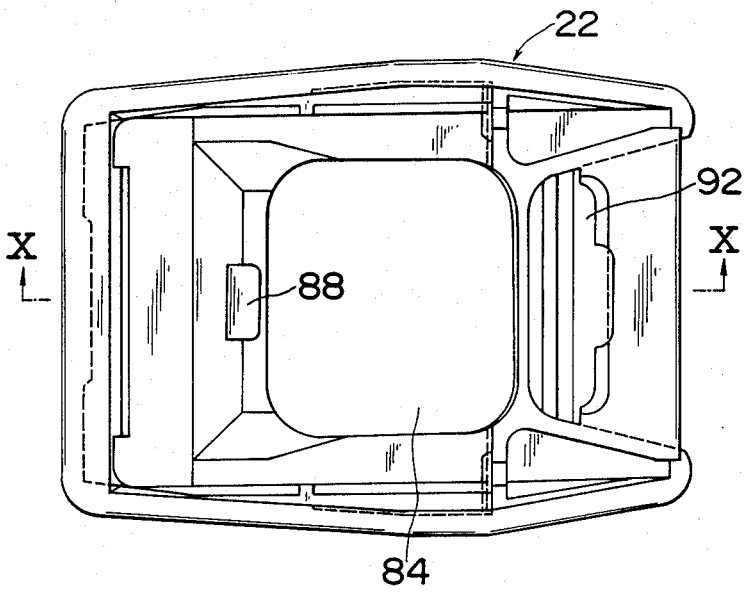
FIG. 9 is a bottom plan view of the buckle cover of the buckle assembly of FIGS. 1 through 3.
Figure 10:
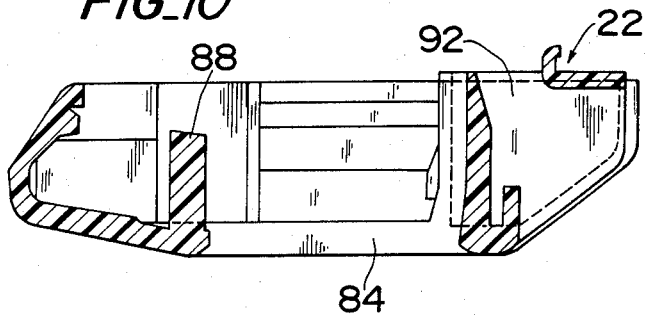
FIG. 10 is a longitudinal section through the buckle cover of FIG. 9, taken along the line X—X therein.

As illustrated in greater detail in FIGS. 9 and 10, the buckle cover 22 has a generally rectangular window 84 provided centrally therein to expose the required part 86 of FIG. 5, therethrough. Just forwardly of the window 84, a guide post 88 depends from the top of the buckle cover 22 and terminates short of the major portion 24 of the base 14. The guide post 88 extends with a running fit through an aperture 90 shown in FIGS. 5 through 7 in the push button 18 and further through the aperture 80 in the push button spring portion 66 of the dual purpose spring 20. The buckle cover 22 further has a slotlike opening 92 provided adjacent its rear end. The unshown webbing to which the buckle assembly 10 is mounted is threaded through this opening 92 in the buckle cover 22 and the aforesaid opening 42 in the base 14.

Operation

Figure 11A:
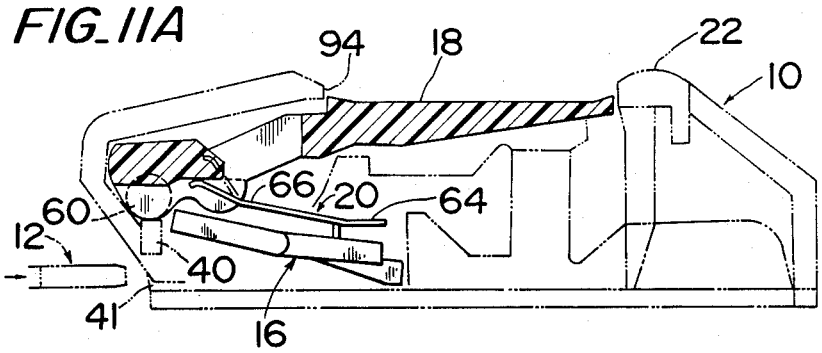
FIG. 11A is a diagrammatic, longitudinal section through the buckle assembly of FIGS. 1 through 3, the view being explanatory of the operation of the buckle assembly and showing the same in a state before insertion of the tongue therein.
Figure 11B:
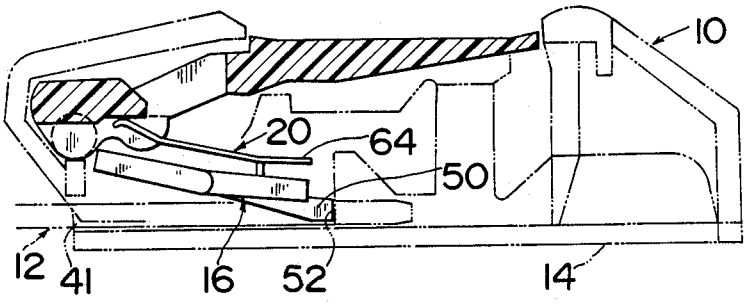
FIG. 11B is a view similar to FIG. 11A and shows the tongue is inserted and latched in the buckle assembly.
Figure 11C:
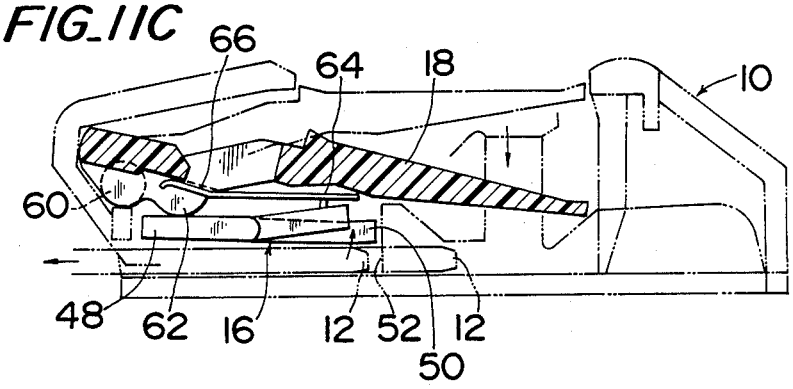
FIG. 11C is also a view similar to FIG. 11A and shows that the tongue is unlatched by the depression of the push button of the buckle assembly.

The operation of the push button buckle assembly 10 will be best understood by referring to FIGS. 11A through 11C. FIG. 11A shows the buckle assembly 10 in a state prior to the insertion of the tongue 12. The push button spring portion 66 of the dual purpose spring 20 biases the push button 18 in a counterclockwise direction about its trunnions 60 and holds the push button in its normal position, where it may abut against a stop 94 formed on the buckle cover 22. Of course, any other stationary part of the buckle assembly 10 could be used as the stop for limiting the pivotal motion of the push button 18 in its normal position. The latch spring portion 64 of the dual purpose spring 20, on the other hand, biases the latch 16 in a clockwise direction about its lugs 54, holding the same in its latching position.

When the tongue is inserted in the buckle assembly 10 through its entrance opening 41, the tongue 12 first comes into sliding contact with the latch 16 and raises the latch toward its unlatching position against the force of the latch spring portion 64, only to an extent necessary for the further travel of the tongue into the buckle assembly.

FIG. 11B shows the tongue 12 inserted fully into the buckle assembly 10. The latch 16 has locked the tongue 12, with the pawl 50 of the latch being engaged with the opening 52 of the tongue, under the force of the latch spring portion 64. The tongue 12 is now positively locked against withdrawal from the buckle assembly 10. It will be appreciated that since the latch is held biased toward its latching position by the latch spring portion 64 during the insertion of the tongue 12, the latch 16 can firmly engage with and lock the tongue upon full insertion thereof without any possibility of loose latching. It will also be recalled that the axis about which the latch 16 pivots on the base 14 passes through its center of gravity in the front to rear direction of the base. Thus, even though the buckle assembly 10 may be subjected to great external forces while being connected with the tongue 12, the latch will stably remain the engagement with the tongue under the force of the latch spring portion 64.

FIG. 11C shows the push button 18 subsequently depressed against the bias of the push button spring portion 66 for unlatching the tongue 12. With the depression of the push button 18, its depending lugs 62 butt on the counterbalance portion 48 of the latch 16, causing the latch 16 to pivot counterclockwise about its lugs 54 against the force of the latch spring portion 64 to the unlatching position of FIG. 11C. Since the lugs 62 of the push button 18 are located close to its trunnions 60, and since the push button is actuated at a point farther away from the trunnions, no great finger pressure will be required for moving the latch 16 to the unlatching position in opposition to the forces of the dual purpose spring 20. The pawl 50 of the latch 16 comes out of engagement of the opening 52 in the tongue 12 upon pivotal motion of the latch to the unlatching position. The tongue 12 is now withdrawable from the buckle assembly 10.

Modification of the First Form

Figures 12, 13:
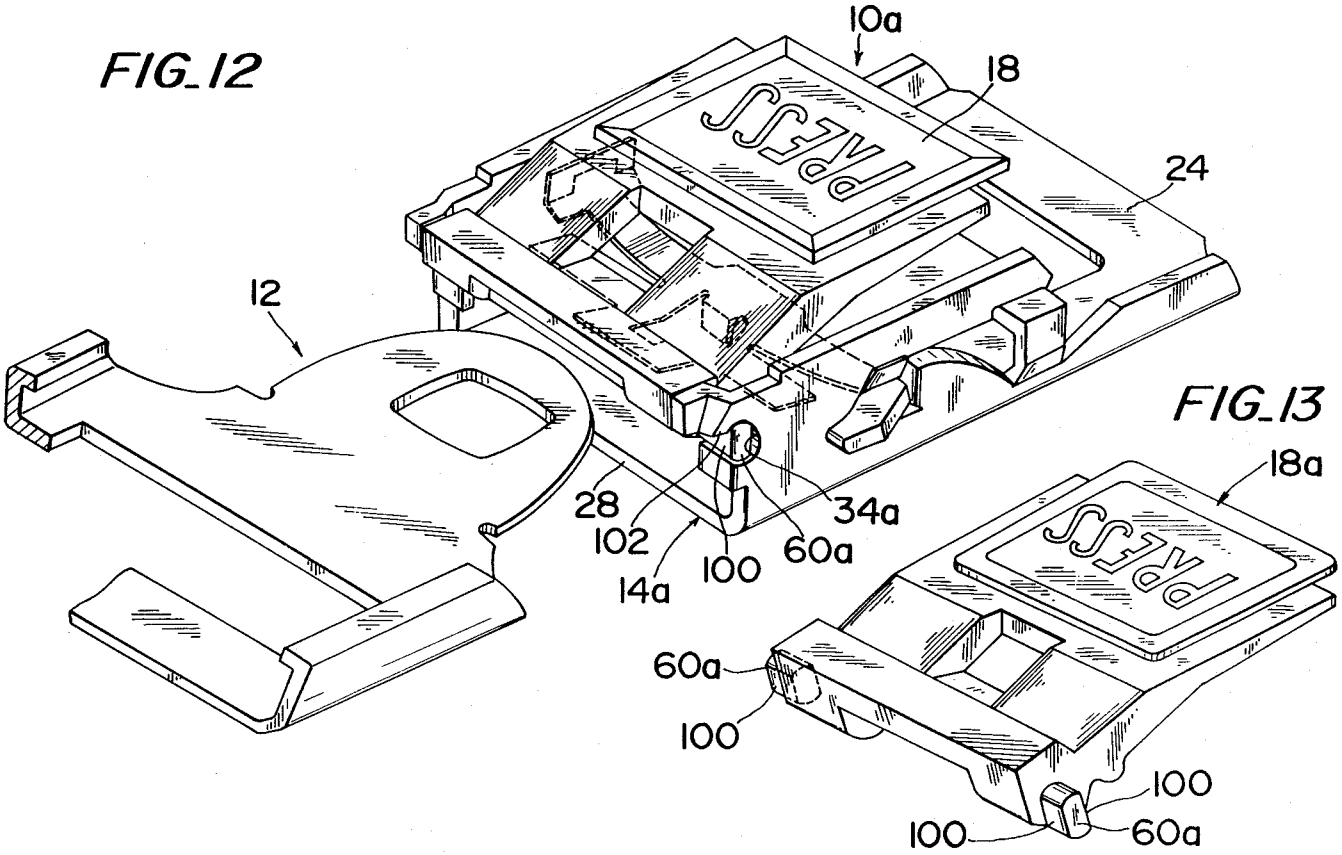
FIG. 12 is a view similar to FIG. 1 but shows a slight modification of the push button buckle assembly of FIGS. 1 through 3.
FIG. 13 is a perspective view of the push button of the modified buckle assembly of FIG. 12.

FIGS. 12 and 13 are illustrations of a minor modification of the preceding embodiment. The modified buckle assembly **10*a* features a push button 18*a* having a pair of trunnions 60*a* of different shape different from that of the trunnions 60 of the preceding embodiment. Each trunnion 60*a* has a pair of diametrically opposed recesses or flat portions 100 cut longitudinally therein, so that each trunnion is substantially flattened. The base 14*a* for use with the push button 18*a* has its second pair of apertures 34*a* modified correspondingly for receiving the trunnions 60*a*. The second pair of apertures 34*a* are open at the front end 28 of the base 14*a* to a minimal extent required for rearwardly receiving the respective trunnions into rotatable engagement therein. In this particular embodiment, a pair of overhangs 102 are formed over each of the second pair of apertures 34*a* for reducing the size of their front end openings so as to prevent the trunnions 60*a*** from jumping out of the apertures.

As will be seen from FIG. 12 in particular, the pair of recesses or flat portions 100 in each trunnion **60*a* are perpendicular to the major portion 24 of the base 14*a* when the push button 18*a* is mounted in position on the base and held in its normal position. The overhangs 102 can therefore effectively retain the trunnions 60*a* in the second pair of apertures 34*a*. At the time of assemblage, then, the trunnions 60*a* can be readily engaged in the second pair of apertures 34*a* by holding the push button 18*a* in an attitude angularly displaced by 90 degrees from its FIG. 12 attitude with respect to the base 14*a***.

The modified buckle assembly **10*a* can be identical in other details of construction and operation with respect to the buckle assembly 10. The tongue 12 for use with the buckle assembly 10*a* can also be of the same structure as that for use with the buckle assembly 10**.

Second Form

Figure 14:
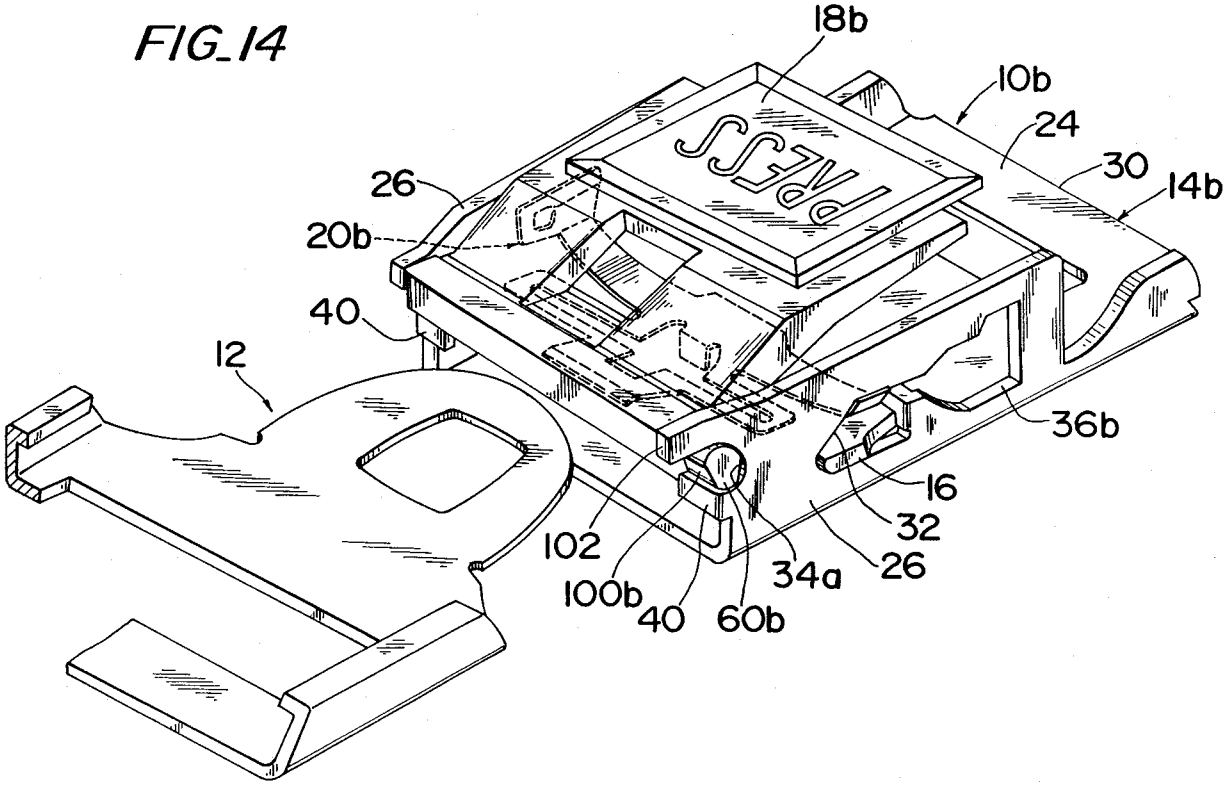
FIG. 14 is a view corresponding to FIG. 1 and shows another preferred form of the push button buckle assembly in accordance with the invention.
Figure 15:
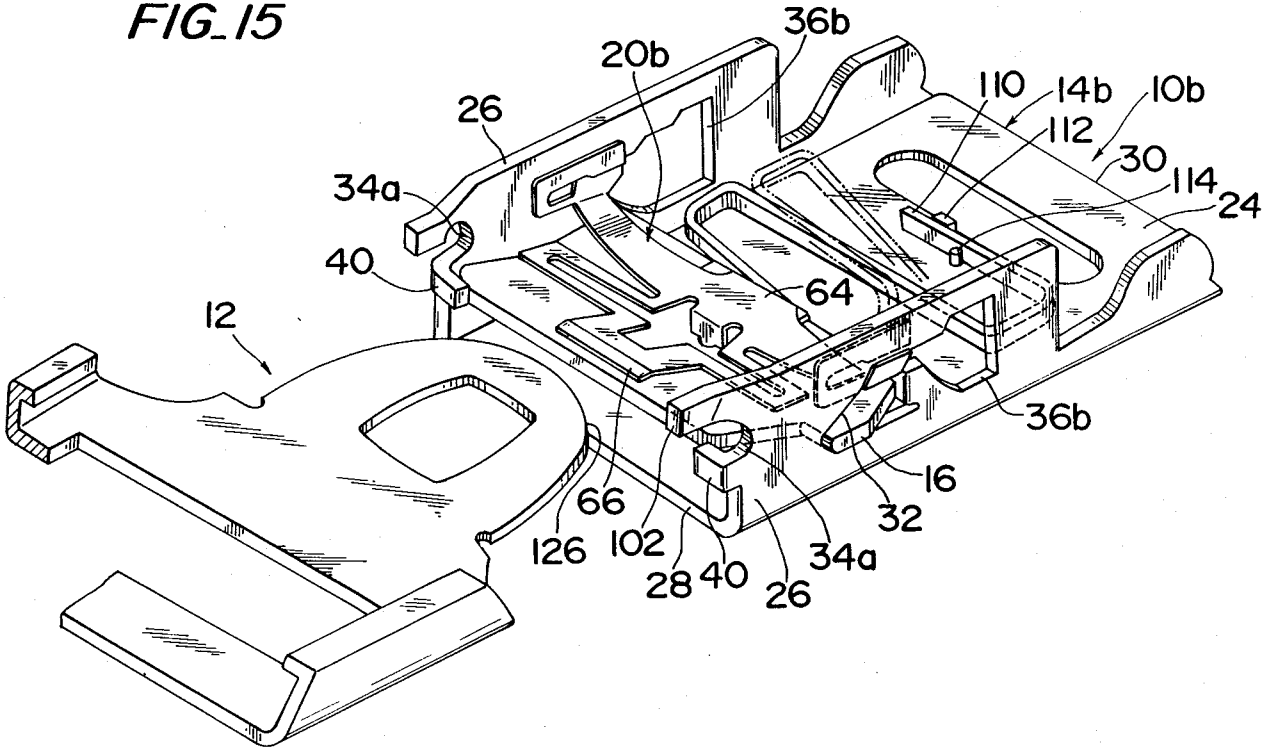
FIG. 15 is a view corresponding to FIG. 2 and shows the buckle assembly of FIG. 14.

The push button buckle assembly constituting the second preferred embodiment of the invention is generally designated **10*b* in FIGS. 14 and 15, and therein shown together with the tongue 12. The buckle assembly 10*b* is further shown as an exploded perspective view in FIG. 16. As will be seen from FIGS. 15 and 16, the buckle assembly 10*b* differs from the foregoing buckle assemblies 10 and 10*a* principally in having a push-out spring 110 for automatically pushing out the tongue 12 therefrom upon unlatching. As for other components of the buckle assembly 10*b*, the latch 16 is identical with that of the buckle assembly 10, but the base 14*b*, push button 18*b*, dual purpose spring 20*b*, and buckle cover 22*b* of the buckle assembly 10*b*** are slightly different from their counterparts in the foregoing embodiments, so that these four modified components will first be described.

Figure 16:
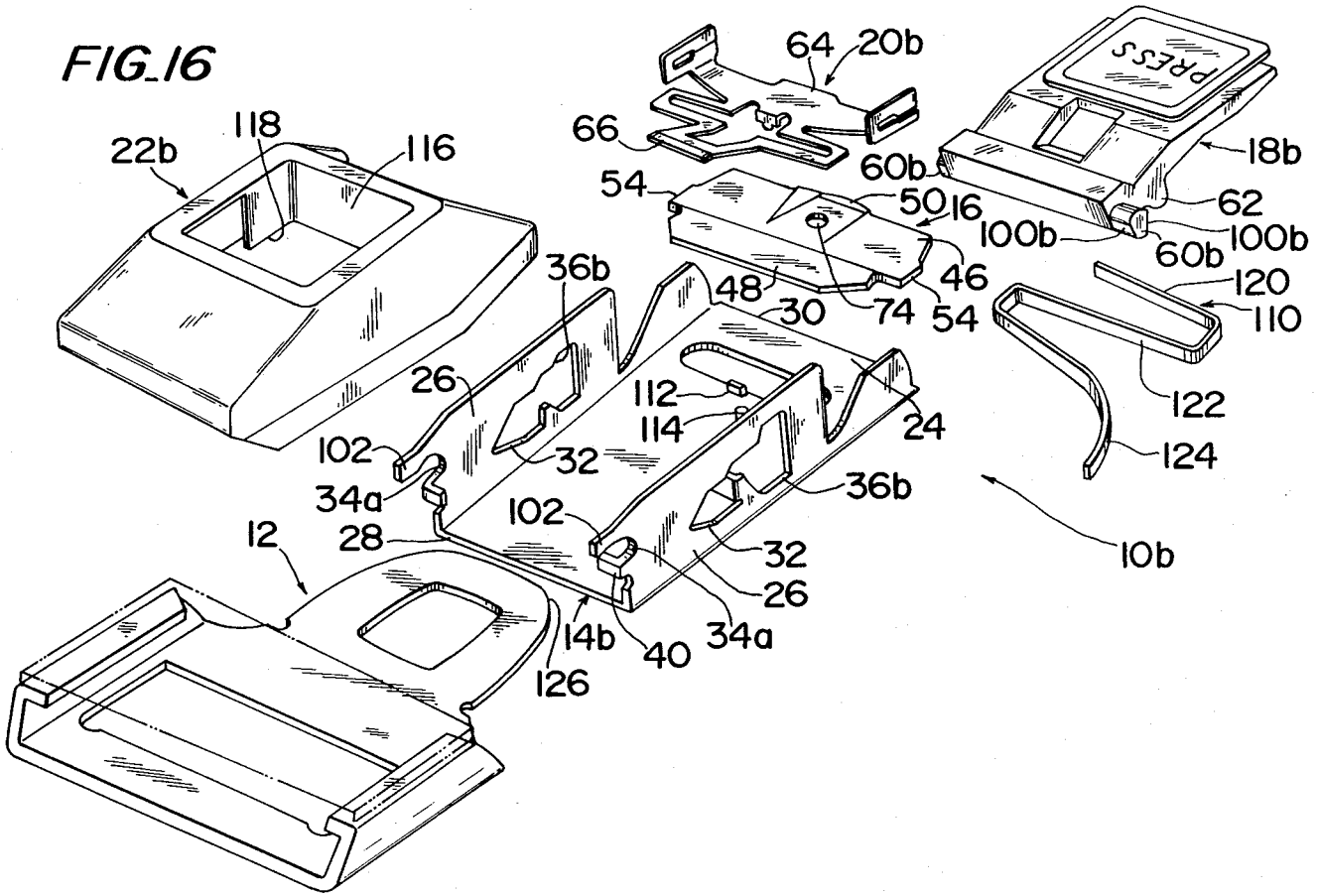
FIG. 16 is a view corresponding to FIG. 3 and shows the buckle assembly of FIGS. 14 and 15.

With reference to FIGS. 14 through 16 the base **14*b* has the first pair of apertures 32 for pivotally receiving the pair of lugs 54 of the latch 16 as well as parts of the dual purpose spring 20*b*, and the second pair of forwardly open apertures 34*a*, with the overhanges 102 and the underlying inward projections 40, for rotatably receiving the trunnions, yet to be described, of the push button 18*b*. The first pair of apertures 32 are directly open respectively to an additional pair of larger apertures 36*b* cut also in the pair of side walls 26 of the base 14*b*. This additional pair of apertures 36*b* is intended to expedite the mounting of the noted parts of the latch 16 and dual purpose spring 20*b* in the first pair of apertures 32 at the time of the assemblage of the buckle assembly 10*b***.

As will be recalled by referring back to FIGS. 1 through 3, the first pair of apertures 32 in the base is made open rearwardly through the passageways 36 if the assemblage of the buckle assembly is automated. For manual assemblage, however, the first pair of aperturs 32 is made open to the pair of larger apertures **6*b*, as in FIGS. 14 through 16, as the latch 16 and dual purpose spring 20*b* can both be manipulated into engagement in the first pair of apertures through the larger apertures 36*b***.

With reference again to FIGS. 15 and 16, the base **14*b* is further formed to include first 112 and second 114 spring retainers 112, 114 projecting from its major portion 24. The first and second spring retainers are located adjacent the rear end 30 of the base 14*b* and midway between the pair of side walls 26. The first spring retainer 112 holds the push-out spring 110 against rearward displacement on the base. The second spring retainer 114 is spaced both forwardly and laterally from the first spring retainer 112 and also holds the pushout spring 110** to prevent its forward displacement.

As will be noted from FIGS. 14 and 16, the push button **18*b* has a slightly modified pair of trunnions 60*b* on its front end. Each trunnion has a pair of recesses 100*b* cut longitudinally therein. The pair of recesses 100*b* are not diametrically parallel to each other, unlike the pair of recesses 100 in each trunnion 60*a* of the FIGS. 12 and 13 push button 18*a*, but are at an angle to each other. The angle between the pair of recesses 100*b* is such that, when the push button 18*b* is in the normal position on the base 14*b* as depicted in FIG. 14, each trunnion 60*b* tapers in cross section toward the major portion 24 of the base. At the time of the assemblage of the buckle assembly 10*b*, therefore, the pair of trunnions 60*b* may be inserted in the second pair of apertures 34*a* in the side walls 26 of the base 14*b* by holding the push button 18*b* approximately perpendicular to the major portion 24 of the base. The trunnions 60*b* of tapering cross section will thus be received in the second pair of apertures 34*a* even more easily than are the trunnions 60*a* of the push button 18*a***. *The push button 18b* is akin in other details of construction to the push button 18 described with particular reference to FIGS. 5 through 7.

Figure 17:
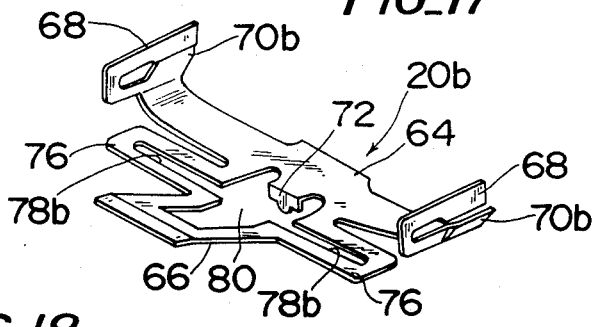
FIG. 17 is a perspective view of the dual purpose spring of the buckle assembly of FIGS. 14 through 16.

The dual purpose spring **20*b* is illustrated in detail in FIG. 17. It has the latch spring portion 64 and the push button spring portion 66. The latch spring portion 64 has the pair of flanges 68 on its opposite lateral ends, together with parts 70*b* of the flanges bent outwardly to firmly engage with the first pair of apertures 32 in the base 14*b*. The depending lub 72 of the latch spring portion 64 engages in the hole 74, FIG. 16, in the latch 16 as in the previous embodiments. The push button spring portion 66 is apertured at 80 and has the pair of wings 76. A slot 78*b* provided in each wing 76 is open directly to the aperture 80 in the push button spring portion 66**.

Figure 18:
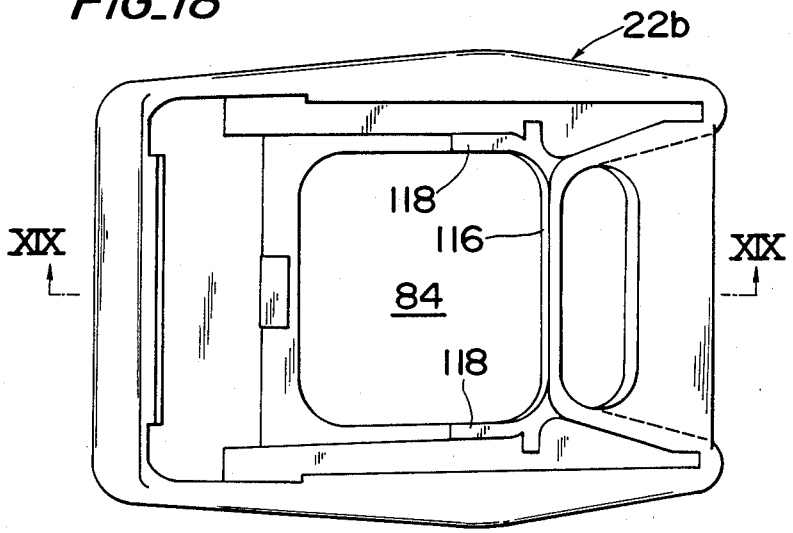
FIG. 18 is a bottom plan view of the buckle cover of the buckle assembly of FIGS. 14 through 16.
Figure 19:
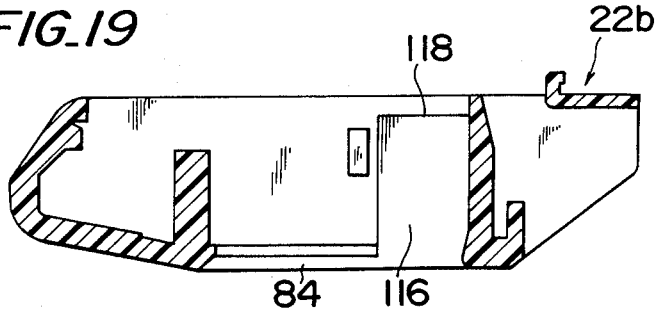
FIG. 19 is a longitudinal section through the buckle cover of FIG. 18, taken along the line XIX—XIX in FIG. 18.

Reference is directed to FIGS. 16, 18 and 19 for a discussion of the modified buckle cover **22*b*. The window 84 in the buckele cover 22*b* comprises in part a push button guide 116 which, as viewed in a plan view of FIG. 18, is U-shaped to conform to the shape of the free end portion of the push button 18*b*. The push button guide 116 extends downwardly from the top of the buckle cover 22*b* and terminates short of the major portion 24 of the base 14*b* to provide a push-out spring guide 118. The push-out spring 110 is mounted between the major portion 24 of the base 14*b* and the push-out spring guide 118, with the spring guide 118 holding the push-out spring against displacement away from the base. Other details of the buckle cover 22*b* are analogous with those of the buckle cover 22 set forth above with particular reference to FIGS. 9 and 10**.

The push-out spring 110, the most pronounced feature of the buckle assembly **10*b*, is shown in FIGS. 15 and 16 as a strip of metal formed approximately into the shape of a "Z". Preferably, the push-out spring 110 is coated with suitable synthetic resin material for the reduction of noise caused when the spring deflects in sliding contact with the major portion 24 of the base 14*b*** in particular.

The push-out spring 110 comprises a straight rear portion 120, a straight intermediate portion 122, and a curved front portion 124. The rear portion 120 of the push-out spring 110 is supported by the first spring retainer 112 on the major portion 24 of the base **14*b* against rearward displacement and supported by the second spring retainer 114 thereon against forward displacement. The intermediate portion 122 of the push-out spring 110 lies forwardly (i.e. toward the front end 28 of the base 14*b*) of the rear portion 120 and serves to connect the rear portions 120 to the front portion 124 lying further forwardly thereof. The front portion 124 of the push-out spring 110 is curved to approximately conform to the rounded leading end portion 126 of the tongue 12 for abutting engagement therewith when the tongue is inserted into the buckle assembly 10*b*. Normally, as will be understood from FIG. 15, the front portion 124 of the push-out spring 110 is at least partly interposed between the major portion 24 of the base 14*b* and the latch 16, with the latch 16 serving to hold the push-out spring against displacement away from the base under the force of the latch spring portion 64 of the dual purpose spring 20*b***.

The buckle assembly **10*b* can be identical in other details of construction with respect to the buckle assembly 10 described in conjunction with FIGS. 1 through 10**.

Operation of the Second Form

Figure 20A:
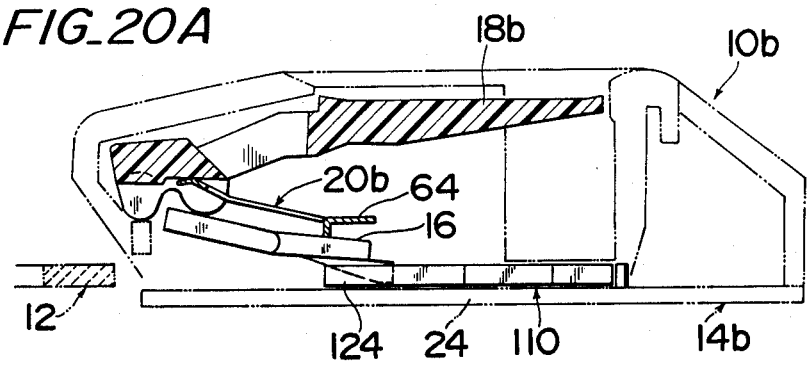
FIGS. 20A, 20B and 20C are a series of views corresponding to FIGS. 11A, 11B and 11C, respectively, and explain the operation of the buckle assembly of FIGS. 14 through 16.
Figure 20B:
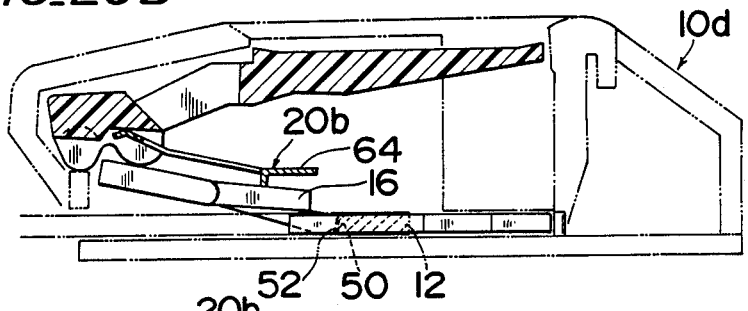
Figure 20C:
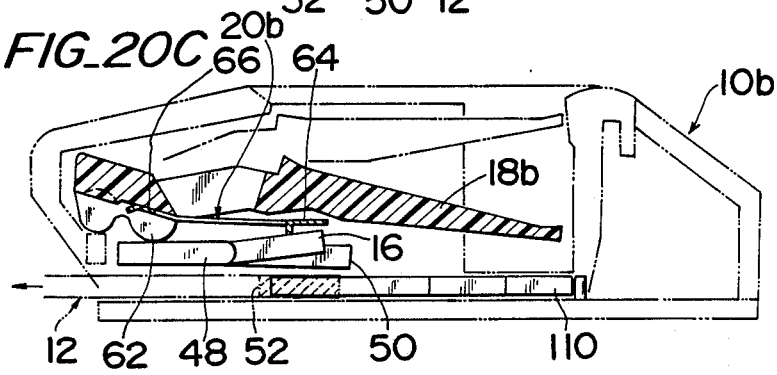

FIGS. 20A through 20C are explanatory of the operation of the buckle assembly **10*b*. Prior to the insertion of the tongue 12, the dual purpose spring 20*b* holds the latch 16 in the latching position, and holds the push button 18*b* in the normal position, as shown in FIG. 20A. The push-out spring 110 has a part of its front portion 124 lying in the space between the major portion 24 of the base 14*b* and the latch 16**.

When the tongue 12 is inserted into the buckle assembly **10*b*, the tongue 12 will first come into contact with the latch 16 and raises the same toward its unlatching position against the force of the latch spring portion 64 of the dual purpose spring 20*b*, only to an extent necessary for the further travel of the tongue deeper into the buckle assembly. The tongue 12 then comes into abutment on the front portion 124 of the push-out spring 110 and will thereafter travels deeper into the buckle assembly 10*b*** against the force of the push-out spring.

FIG. 20B shows the tongue 12 inserted fully into the buckle assembly **10*b*. The latch 16 has locked the tongue 12, with the pawl 50 of the of the tongue the opening 52 in the latter, under the force of the latch spring portion 64 of the dual purpose spring 20*b*. The tongue 12 is now positively locked against withdrawal from the buckle assembly 10*b*. It will be appreciated that, since the latch is held biased toward its latching position by the latch spring portion 64 during the insertion of the tongue 12, the latch 16** can firmly latch and lock the tongue upon full insertion thereof without any possibility of loose latching.

Figure 21:
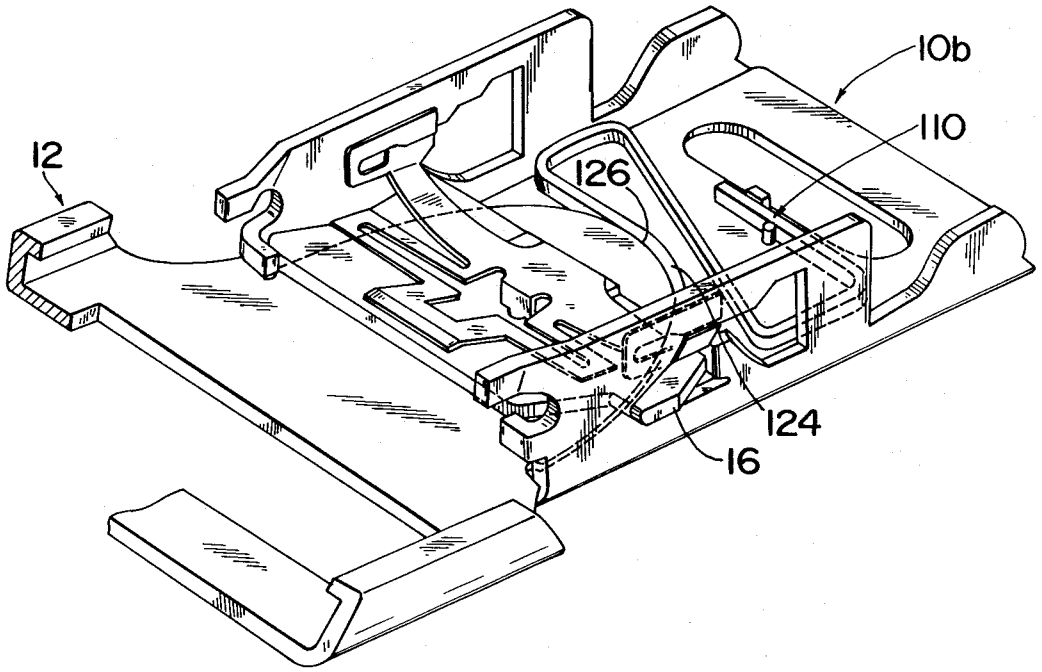
FIG. 21 is a perspective view showing the tongue latched in the buckle assembly of FIGS. 14 through 16, the buckle assembly being shown without the push button and buckle cover to clearly reveal the other components thereof.

FIG. 21 also shows the buckle assembly **10*b* and tongue 12 that have been interengaged as above. It will be seen from this figure that the push-out spring 110 is in a state of full compression, with its curved front portion 124 being in abutting engagement with the rounded leading end portion 126 of the tongue 12. The compressed push-out spring 110 exerts a force on the tongue 12 tending to push the same out of the buckle assembly 10*b*. Accordingly, in cases where the tongue 12 is inserted into the buckle assembly 10*b* only to an extent less than full engagement with the latch 16, the push-out spring 110** will push the tongue out of the buckle assembly.

FIG. 20C shows the push button **18*b* subsequently depressed against the bias of the push button spring portion 66 of the dual purpose spring 20*b* for unlatching the tongue 12. With the depression of the push button 18*b*, its depending lugs 62 butt on the counterbalance portion 48 of the latch 16, causing the to pivot counterclockwise about its lugs 54 relative to the base 14*b* against the force of the latch spring portion 64 to the unlatching position of FIG. 20C. The pawl 50 of the latch 16 comes out of engagement from the opening 52 of the tongue 12 upon pivotal motion of the latch to the unlatching position. Thereupon, the pushout spring 110 pushes the tongue 12 out of the buckle assembly 10*b***.

Modifications of the Second Form

Figure 22:
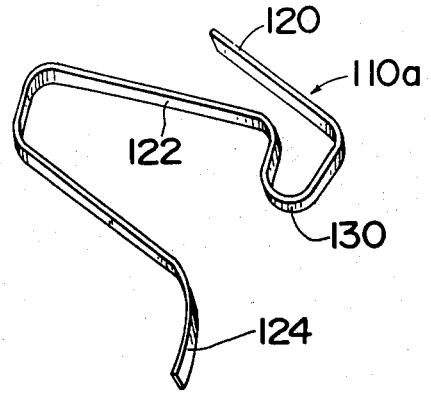
FIG. 22 is a perspective view of an alternative form of the push-out spring for use in the buckle assembly of FIGS. 14 through 16.
Figure 23:
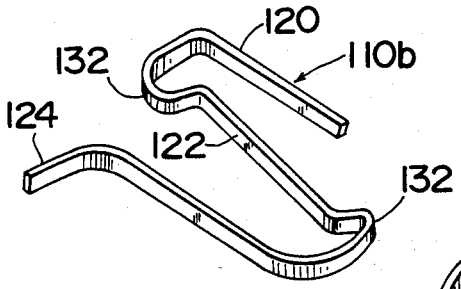
FIG. 23 is a perspective view of another alternative form of the push-out spring for use in the buckle assembly of FIGS. 14 through 16.
Figure 24:
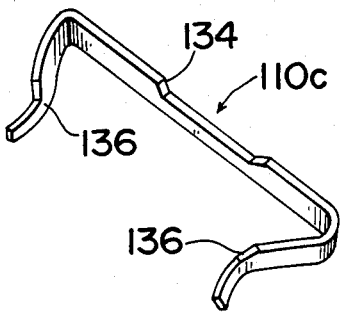
FIG. 24 is a perspective view of still another alternative form of the push-out spring for use in the buckle assembly of FIGS. 14 through 16.

The push-out spring 110 in the buckle assembly **10*b* accepts a variety of modifications for the performance of the same functions as above mentioned. FIGS. 22 through 24** illustrate just three of such modified push-out springs.

The modified push-out spring **110*a* of FIG. 22 differs from the first presented push-out spring 110 in having a bulging bight 130 between the straight rear portion 120** and intermediate portion 122. The front portion 124 of the pushout spring 110*a* is curved just like that of the push-out spring 110 to conform to the rounded end portion of the tongue. The bulging bight 130 serves to increase the restoring force of the push-out spring 110*a*.

For the same purpose, in another modified push-out spring 110*b* shown in FIG. 23, a similar bulging bight 132 is formed not only between the rear portion 120 and the intermediate portion 122, but also between the intermediate portion 122 and the curved front portion 124.

While all the foregoing push-out springs 110, 110*a* and 110*b* are more or less Z-shaped, a still another modified push-out spring 110*c* of FIG. 24 is approximately U-shaped. It comprises a straight main portion 134 mounted transversely on the major portion of the base of the buckle assembly, and a pair of arms 136 extending from the opposite ends of the main portion 134 toward the front end of the base for abutting engagement with the tongue. The arms 136 may be suitably curved, as shown, for proper engagement with the opposite sides of the rounded leading end portion of the tongue. For mounting this push-out spring 110*c* on the base of the buckle assembly, three projections may be formed on its major portion, instead of the two projections 112 and 114 seen in FIG. 16, in positions forming the apexes of an isosceles triangle.

Third Form

Figure 25:
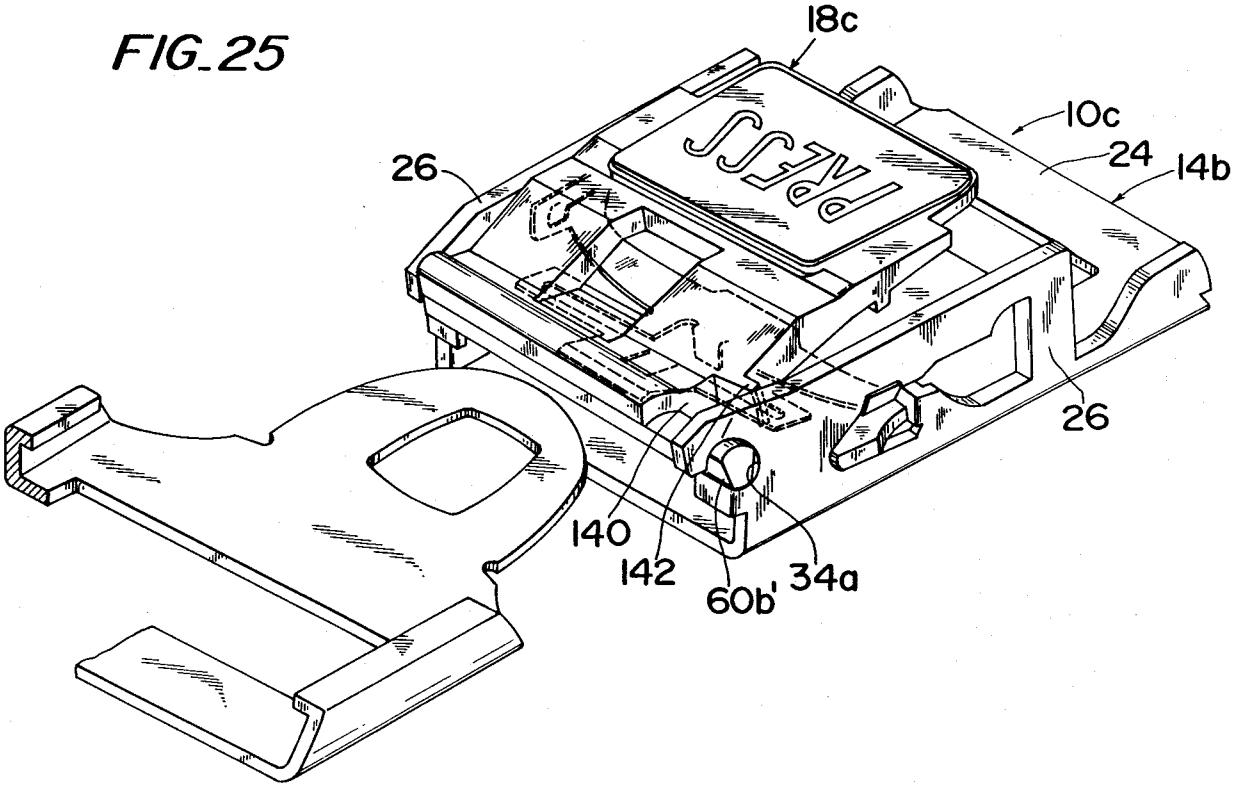
FIG. 25 is a view corresponding to FIG. 1 and showing still another preferred form of the push button buckle assembly in accordance with the invention.
Figure 26:
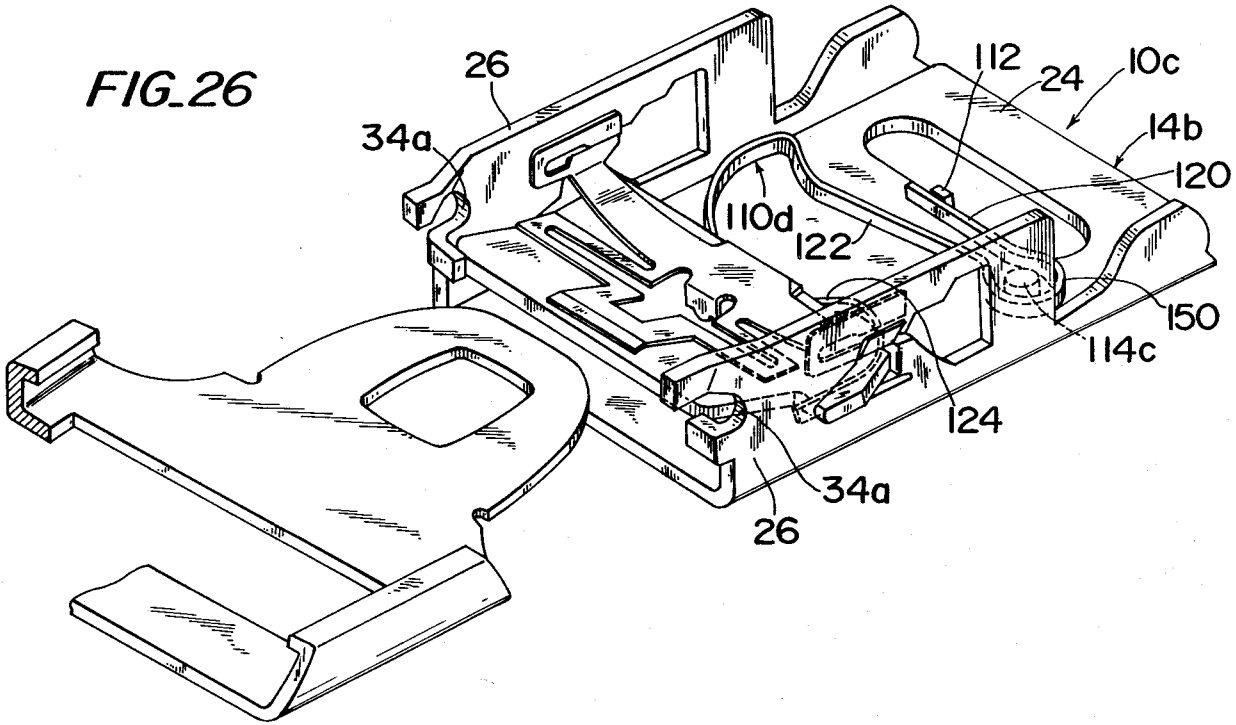
FIG. 26 is a view corresponding to FIG. 2 and shows the buckle assembly of FIG. 25.

FIGS. 25 and 26 illustrate the third preferred form of the push button buckle assembly in accordance with the invention, generally designated 10*c*. The buckle assembly 10*c* features a modified push button 18*c* and a modified push-out spring 110*d*. Other components of the buckle assembly 10*c* are of essentially the same constructions as their counterparts of the buckle assembly 10*b* of FIGS. 14 through 21, so that they will be identified, if necessary, by the same reference characters as used to denote the corresponding parts of the buckle assembly 10*b*.

Figure 27:
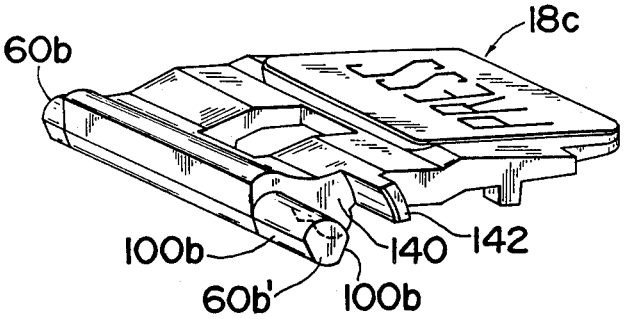
FIG. 27 is a perspective view of the push button of the buckle assembly of FIGS. 25 and 26.
Figure 28:
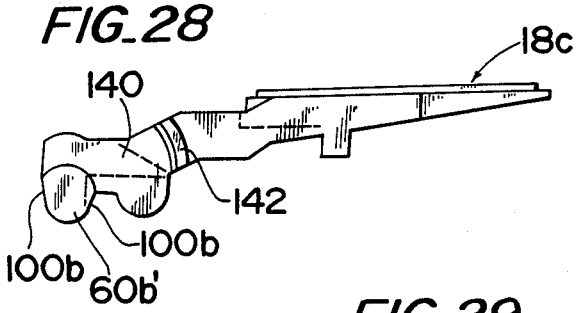
FIG. 28 is a side elevation of the push button of FIG. 27.

Although the push button 18*c* appears fully in FIG. 25, FIGS. 27 and 28 better illustrate its features designed to make easier its mounting on the base 14*b*. The push button 18*c* has a pair of trunnions 60*b* and 60*b*′ shaped just like those of the push button 18*b* of the buckle assembly 10*b*, each having the pair of nonparallel recesses or flat portions 100*b* defined longitudinally therein. Further, just behind the trunnion 60*b*′, the push button 18*c* has an indentation 140 formed therein, although another such indentation could be formed behind the other trunnion 60*b* as well. The indentation 140 is bounded at its end opposite the trunnion 60*b*′ by a relatively protruding spacer 142 molded in one piece with the push button 18*c*. As the push button 18*c* pivots about its trunnions 60*b* and 60*b*′ on the base 14*b* between its normal and working positions, the spacer 142 slides along the inside surface of one of the side walls 26 of the base for holding the push button 18*c* in position on the base in a transverse direction of the latter. The push button 18*c* is analogous in other structural details with the push buttons 18, 18*a* and 18*b* set forth in the foregoing.

For mounting the push button 18*c* on the base 14*b*, the push button is held approximately perpendicular to the plane of the base. Then, with that attitude of the push button maintained with respect to the base 14*b*, the trunnion 60*b*′ having the indentation 140 behind it is first inserted into the corresponding one of the apertures 34*a* in the base. Then the other trunnion 60*b* is held in axial alignment with the other aperture 34*a* in the base 14*b* and is inserted therein by moving the push button 18*c* relative to the base in the axial direction of the trunnions 60*b* and 60*b*′. The push button 18*c* is then turned about its trunnions 60*b* and 60*b*′ toward the major portion 24 of the base 14*b* until the protuberant spacer 142 thereon comes into sliding contact with the inside surface of one of the side walls 26 of the base. The mounting of the push button 18*c* on the base 14*b* has now been completed.

Although the pair of apertures 34*a* in the base 14*b* are shown to be open forwardly, the pair of trunnions 60*b* and 60*b*′ of the push button 17*c* could be inserted therein in the above described manner if they are closed.

Figure 29:
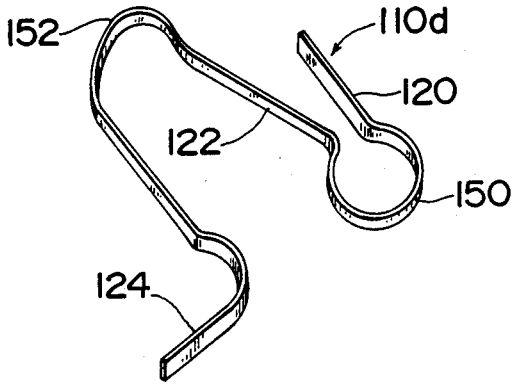
FIG. 29 is a perspective view of the push-out spring of the buckle assembly of FIGS. 25 and 26.

The push-out spring 110*d* of the buckle assembly 10*c* is illustrated in detail in FIG. 29. It is approximately Z-shaped, and comprises the straight rear portion 120, straight intermediate portion 122, and curved front portion 124. The push-out spring 110*d* is further formed to include a first bulding bight 150 between rear portion 120 and intermediate portion 122, and a second bulding bight 152 between intermediate portion 122 and front portion 124, increase to the force of the spring. The first bight 150 is approximately circular in shape. Thus, although slight different in shape, this push-out spring 110*d* can be considered essentially identical with the push-out spring 110*b* of FIG. 23.

As will be seen by referring back to FIG. 26, the rear portion 120 of the push-out spring 110*d* is held against the first spring retainer 112 formed on the base 14*b* midway between its pair of side walls 26. A second spring retainer 114*c* on the base 14*b* is located close to one of its side walls 26 and is loosely engaged with the first bight 150 of the push-out spring 110*d* to hold the same against forward displacement relative to the base.

It will, of course, be understood that various changes may be made in the form, details, arrangements, and proportions of the parts of the buckle assemblies disclosed herein, as well as of the tongue for use therewith, without departing from the scope of this invention.

What is claimed is:

1. A seat belt buckle assembly capable of positive and quick release engagement with a tongue, the buckle assembly comprising:

(a) a base having a front end through which the tongue is inserted in and withdrawn from the buckle assembly, and a rear end opposite the front end, the base comprising a generally flat major portion of generally rectangular shape and a pair of opposed side walls provided on and extending along the opposite sides of the major portion, the side walls having therein means defining a first pair of opposed apertures located intermediate the front and rear ends of the base and means defining a second pair of opposed apertures which open at the front end of the base;

(b) a latch having a pair of opposite ends engaged in the first pair of apertures in the side walls of the base for pivotal motion about a first axis, which extends through the center of gravity of the latch, relative to the base between a latching position for positive engagement with the tongue inserted in the buckle assembly and an unlatching position for releasing the tongue;

(c) a push button generally overlying the latch and having a pair of trunnions projecting laterally from the front end of the push button, the trunnions being inserted rearwardly into the second pair of apertures and being rotatably engaged in the side walls of the base for pivotal motion about a second axis, which extends parallel to the first axis, relative to the base between a normal position for holding the latch in the latching position and a working position for holding the latch in the unlatching position; and (d) a dual-purpose integral spring mounted on the base and disposed between the latch and the push button, the dual-purpose spring having a first spring portion extending laterally of the base between the opposed side walls thereof for connecting the spring to the base and acting directly on the latch for normally urging the latch in the latching position, a second spring portion protruding forwardly with respect to the first portion and acting directly on the push button for normally urging the push button in the normal position, and a mid spring portion interconnecting the first and second spring portions, the mid spring portion comprising a pair of wings extending laterally of the base, each wing having a pair of opposed leg portions extending laterally in the widthwise direction of the base, one end of one leg portion being connected to the first spring portion and the corresponding one end of the other leg portion being connected to the second spring portion, and a connecting portion interconnecting the other ends of the pair of leg portions;

(e) the push button being operative when pushed manually from the normal position to the working position against the force of the dual-purpose spring to act directly on the latch for pivoting the same from the latching position to the unlatching position against the force of the dual-purpose spring.

2. The seat belt buckle assembly of claim 1; wherein the side walls of the base define a pair of passageways which open toward the rear end of the base and communicate with the first pair of apertures respectively, and the pair of opposite ends of the latch are inserted through the passageways and are pivotably engaged in the first pair of apertures.

3. The seat belt buckle assembly of claim 2; wherein the side walls of the base include a pair of bridges each having opposite ends anchored respectively to the opposite edges of one side wall of the base bounding one of the first pair of apertures therein, the pair of bridges bulging away from each other so as to allow the pair of opposite ends of the latch to be inserted through the passageways into engagement in the first pair of apertures.

4. The seat belt buckle assembly of claim 1; wherein the side walls of the base have means defining an additional pair of larger apertures communicating with respective ones of the first pair of smaller apertures.

5. The seat belt buckle assembly of claim 1; wherein the latch comprises:

(a) a body portion having a pawl extending therefrom toward the rear end of the base for engagement with the tongue; and (b) a counterweight portion extending from the body portion of the latch toward the front end of the base for counterbalancing the combined weight of the body portion and the pawl.

6. The seat belt buckle assembly of claim 5; wherein the push button comprises a pair of transversely spaced depending lugs which make abutting engagement with the counterweight portion of the latch for pivoting the same from the latching position to the unlatching position.

7. The seat belt buckle assembly of claim 1; wherein the push button comprises a pair of depending lugs formed in one piece with the push button, the depending lugs of the push button making abutting engagement with the latch upon depression of the push button.

8. The seat belt buckle assembly of claim 7; wherein the pair of trunnions of the push button are located at the front end thereof, and the pair of depending lugs are located close to the trunnions in order to allow the push button to actuate the latch by a leverage operation.

9. The seat belt buckle assembly of claim 1; wherein the pair of opposed side walls of the base include a pair of projections extending therefrom toward each other in the immediate vicinity of the second pair of apertures in the side walls of the base, the projections of the side walls serving to rotatably support the trunnions of the push button and further defining, in combination with the major portion of the base, an entrance opening for the insertion of the tongue in the buckle assembly.

10. The seat belt buckle assembly of claim 1; wherein each of the pair of trunnions of the push button has a pair of flat portions disposed longitudinally therein whereby each trunnion is substantially flattened, and wherein the second pair of apertures in the side walls of the base are open at the front end of the base to a minimal extent required for receiving the respective flattened trunnions into pivotal engagement therein.

11. The seat belt buckle assembly of claim 10; wherein the pair of flat portions in each trunnion of the push button are diametrically opposed to, and are parallel to, each other.

12. The seat belt buckle assembly of claim 10; wherein the pair of flat portions in each trunnion of the push button are at such an angle to each other that when the push button is in the normal position on the base, the cross section of each trunnion tapers toward the major portion of the base.

13. The seat belt buckle assembly of claim 1; wherein the push button has means defining an indentation disposed behind at least one of the trunnions to facilitate the insertion of the trunnions in the second pair of apertures in the side walls of the base at the time of the assemblage of the buckle assembly, and a spacer disposed adjacent to the indentation and projecting from the push button in a parallel spaced relation to said one trunnion, the spacer being capable of sliding engagement with one of the side walls of the base during the pivotal motion of the push button between the normal and working positions in order to hold the push button in position between the pair of side walls of the base.

14. The seat belt buckle assembly of claim 1; wherein the first portion of the dual-purpose spring has a pair of opposite ends rigidly coupled to the base.

15. The seat belt buckle assembly of claim 14; wherein the pair of opposite ends of the first portion of the dual-purpose spring are firmly engaged respectively in the first pair of apertures in the side walls of the base.

16. The seat belt buckle assembly of claim 14; wherein the first portion of the dual-purpose spring has an intermediate portion convexedly deflected toward the major portion of the base between the pair of opposite ends of the first portion.

17. The seat belt buckle assembly of claim 1; wherein the first portion of the dual-purpose spring has a lug depending therefrom and acts on the latch to make positive engagement therewith.

18. The seat belt buckle assembly of claim 1; further comprising a pushout spring for pressing the tongue out of the buckle assembly when the tongue is unlatched upon pivotal motion of the push button from the normal position to the working position.

19. The seat belt assembly of claim 18; wherein the pushout spring comprises a strip of resilient material and mounted on the major portion of the base at least partly in an underlying relation to the latch.

20. The seat belt buckle assembly of claim 19; wherein the pushout spring comprises generally the shape of a "Z", comprising:

(a) a rear portion held on the major portion of the base against displacement;

(b) an intermediate portion extending from the rear portion toward the front end of the base; and (c) a front portion extending from the intermediate portion toward the front end of the base, normally in an underlying relation to the latch, and abutting with the tongue inserted in the buckle assembly.

21. The seat belt buckle assembly of claim 20; wherein the pushout spring includes a bulging bight between the rear portion and the intermediate portion thereof.

22. The seat belt buckle assembly of claim 21; wherein the pushout spring includes a second bulging light between the intermediate portion and the front portion thereof.

23. The seat belt buckle assembly of claim 19; wherein the pushout spring comprises generally the shape of a "U", comprising: .

(a) a main portion held fast on the major portion of the base; and (b) a pair of arms extending from the opposite ends of the main portion toward the front end of the base and abutting with the tongue inserted in the buckle assembly.

24. The seat belt buckle assembly of claim 19; further comprising a buckle cover rigidly mounted to the base and coacting therewith to enclose at least the latch, the dual-purpose spring and the pushout spring, the buckle cover having a window therein for exposing at least part of the push button for manual activation, and further having a guide held opposite the major portion of the base for guiding the deflection of the pushout spring on the base.

25. The seat belt buckle assembly of claim 1; wherein the second portion of the dual-purpose spring has a tip end extending forwardly from the second portion and directly contacting with the push button.

26. A buckle assembly for latching a tongue therein, comprising: a base having a major portion for receiving the tongue when the same is inserted into the buckle assembly, a front end, and a pair of opposed side walls upwardly extending from the major portion and rearwardly extending from the front end, the opposed side walls having means defining a pair of opposed apertures which open at the front end of the base; a latch disposed on the major portion of the base and having a center of gravity and an axis extending along the center of gravity; supporting means for pivotably supporting the latch between the side walls at the axis thereof such that the latch is pivotable around the axis thereof between a latching position in which the latch is urged toward the base major portion to engage with the tongue inserted between the latch and the base major portion, and an unlatching position in which the latch disengages from the tongue to release the same; a push button disposed on the latch and having a pair of trunnions projecting laterally from a front end of the push button, the trunnions being inserted rearwardly into the pair of opposed apertures so that the push button pivots around the trunnions relative to the latch between a normal position in which the push button is urged away from the latch, and a working position in which the push button is manually operative to pivot the latch to the unlatching position; and integral spring means interposed between the latch and the push button, the integral spring means having a first spring portion extending laterally of the base between the side walls for connecting the spring means to the base and directly acting on the latch for directly urging the latch toward the major portion of the base, a second spring portion protruding forwardly with respect to the first portion and directly acting on the bush button for directly urging the push button away from the latch, and a mid spring portion interconnecting the first and second spring portions, the mid spring portion comprising a pair of wings extending laterally of the base, each wing having a pair of opposed leg portions extending laterally in the widthwise direction of the base, one end of one leg portion being connected to the first spring portion and the corresponding one end of the other leg portion being connected to the second spring portion, and a connecting portion interconnecting the other ends of the pair of leg portions.

27. A buckle assembly according to claim 26; wherein the supporting means comprises another pair of opposed apertures provided in the respective ones of the side walls and located rearwardly from the first pair of opposed apertures for receiving therein a pair of opposite ends of the latch pivotally inserted into the another pair of opposed apertures.

28. A buckle assembly according to claim 26; wherein the latch comprises a body portion having a pawl extending rearwardly thereof for latching the tongue, and a counterweight portion extending forwardly from the body portion for counterbalancing the total weight of the body portion and the pawl.

29. A buckle assembly according to claim 28; wherein the push button is mounted to act on the counterweight portion of the latch so as to pivot the latch from the latching portion to the unlatching position.

30. A buckle assembly according to claim 26; wherein the push button has a pair of depending lugs integrally formed with the push button and provided on a bottom portion thereof, the depending lugs abutting with the latch and pivoting the latch to the unlatching position upon manual depression of the push button to the working position.

31. A buckle assembly according to claim 30; wherein the pair of depending lugs are located close to and rearwardly from the pair of trunnions so as to enable the push button to actuate the latch by a leverage operation around the trunnions.

32. The buckle assembly according to claim 26; wherein the first portion of the integral spring means has a pair of opposite ends rigidly coupled to the side walls of the base.

33. The buckle assembly according to claim 32; wherein the first portion of the integral spring means has an intermediate portion convexedly deflected toward the major portion of the base between the pair of opposite ends of the first portion.

34. A buckle assembly according to claim 33; wherein the intermediate portion has a lug depending downwardly therefrom and acting on the latch to make positive engagement therewith.

35. A buckle assembly according to claim 26; including a push-out spring disposed on the major portion of the base for pressing the tongue forwardly so as to automatically release the tongue upon the pivotal movement of the push button from the normal position to the working position.

36. A buckle assembly according to claim 26; including a buckle cover rigidly mounted on the base for covering the latch, the spring means, and push button.

37. A buckle assembly according to claim 26; wherein the second portion of the internal spring means has a tip end extending forwardly from the second portion and directly contacting with the push button.

* * * * *